US009562401B1

(12) United States Patent
Smith

(10) Patent No.: US 9,562,401 B1
(45) **Date of Patent: *Feb. 7, 2017**

(54) DRILLING RIG WITH MINI-STABILIZER TOOL

(71) Applicant: ALASKAN ENERGY RESOURCES, INC., Anchorage, AK (US)

(72) Inventor: Lee Morgan Smith, Anchorage, AK (US)

(73) Assignee: ALASKAN ENERGY RESOURCES, INC., Anchorage, AK (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/835,651

(22) Filed: Aug. 25, 2015

Related U.S. Application Data

(63) Continuation-in-part of application No. 14/631,428, filed on Feb. 25, 2015, now Pat. No. 9,145,746.

(60) Provisional application No. 62/002,639, filed on May 23, 2014.

(51) Int. Cl.

| | |
|---|---|
| ***E21B 17/10*** | (2006.01) |
| ***E21B 10/26*** | (2006.01) |
| ***E21B 15/00*** | (2006.01) |
| ***E21B 3/02*** | (2006.01) |
| ***E21B 33/06*** | (2006.01) |
| ***E21B 19/02*** | (2006.01) |
| ***E21B 10/46*** | (2006.01) |
| ***E21B 47/01*** | (2012.01) |

(52) U.S. Cl.
CPC ..... *E21B 17/1078* (2013.01); *E21B 3/02* (2013.01); *E21B 10/26* (2013.01); *E21B 10/46* (2013.01); *E21B 15/00* (2013.01); *E21B 19/02* (2013.01); *E21B 33/06* (2013.01); *E21B 47/01* (2013.01)

(58) Field of Classification Search
CPC ..... E21B 10/26; E21B 10/30; E21B 17/1078; E21B 17/1085
See application file for complete search history.

(56) References Cited

U.S. PATENT DOCUMENTS

| | | | |
|---|---|---|---|
| 3,285,678 | A | 11/1966 | Garrett et al. |
| 3,420,323 | A | 1/1969 | Owens |
| 3,945,446 | A | 3/1976 | Ostertag et al. |
| 4,011,918 | A | 3/1977 | Jurgens |
| 4,081,203 | A | 3/1978 | Fuller |
| 4,231,437 | A | 11/1980 | Swersky et al. |
| 4,277,869 | A | 7/1981 | Hartwell |
| 4,385,669 | A | 5/1983 | Knutsen |
| 4,396,234 | A | 8/1983 | Garrett |
| 4,610,316 | A | 9/1986 | Boaz |
| 4,664,206 | A | 5/1987 | Butler |
| 6,213,229 | B1 | 4/2001 | Majkovic |
| 7,650,952 | B2 | 1/2010 | Evans et al. |

(Continued)

FOREIGN PATENT DOCUMENTS

WO 2013167954 A1 11/2013

*Primary Examiner* — Robert E Fuller
(74) *Attorney, Agent, or Firm* — Buskop Law Group, PC; Wendy Buskop

(57) ABSTRACT

A drilling rig with mini-stabilizer tool for connecting to a measurement while drilling (MWD) system. The mini-stabilizer tool centralizes components in the wellbore for a more accurate measurement to protect measurement while drilling components from wear on shoulders of the measurement while drilling components. The mini-stabilizer tool accomplishes wear prevention by positioning the measurement while drilling components away from edges of the wellbore.

16 Claims, 4 Drawing Sheets

(56) References Cited

U.S. PATENT DOCUMENTS

| | | | |
|---|---|---|---|
| 8,162,081 | B2 | 4/2012 | Ballard et al. |
| 2006/0219441 | A1 | 10/2006 | Telfer |
| 2008/0149396 | A1 | 6/2008 | Fyfe |
| 2012/0255786 | A1 | 10/2012 | Isenhour |
| 2013/0180779 | A1 | 7/2013 | Isenhour |

DRILLING RIG WITH MINI-STABILIZER TOOL

CROSS REFERENCE TO RELATED APPLICATION

The current application is a Continuation in Part and claims priority to and the benefit of co-pending U.S. patent application Ser. No. 14/931,428 filed on Feb. 25, 2015, which claims priority to and the benefit of U.S. Provisional Patent Application Ser. No. 62/002,639 filed on May 23, 2014, both entitled "MINI-STABILIZER TOOL." These references are hereby incorporated in their entirety.

FIELD

The present embodiments relate to a drilling rig with mini-stabilizer tool.

BACKGROUND

A need exists for a drilling rig that protects drilling and measurement while drilling components, centralizes drilling and measurement while drilling equipment from particles dislodged while cutting a wellbore, while additionally smoothing a bore as the drill string is pulled in and out of the wellbore.

The present embodiments meet these needs.

BRIEF DESCRIPTION OF THE DRAWINGS

The detailed description will be better understood in conjunction with the accompanying drawings as follows.

Figure 1:
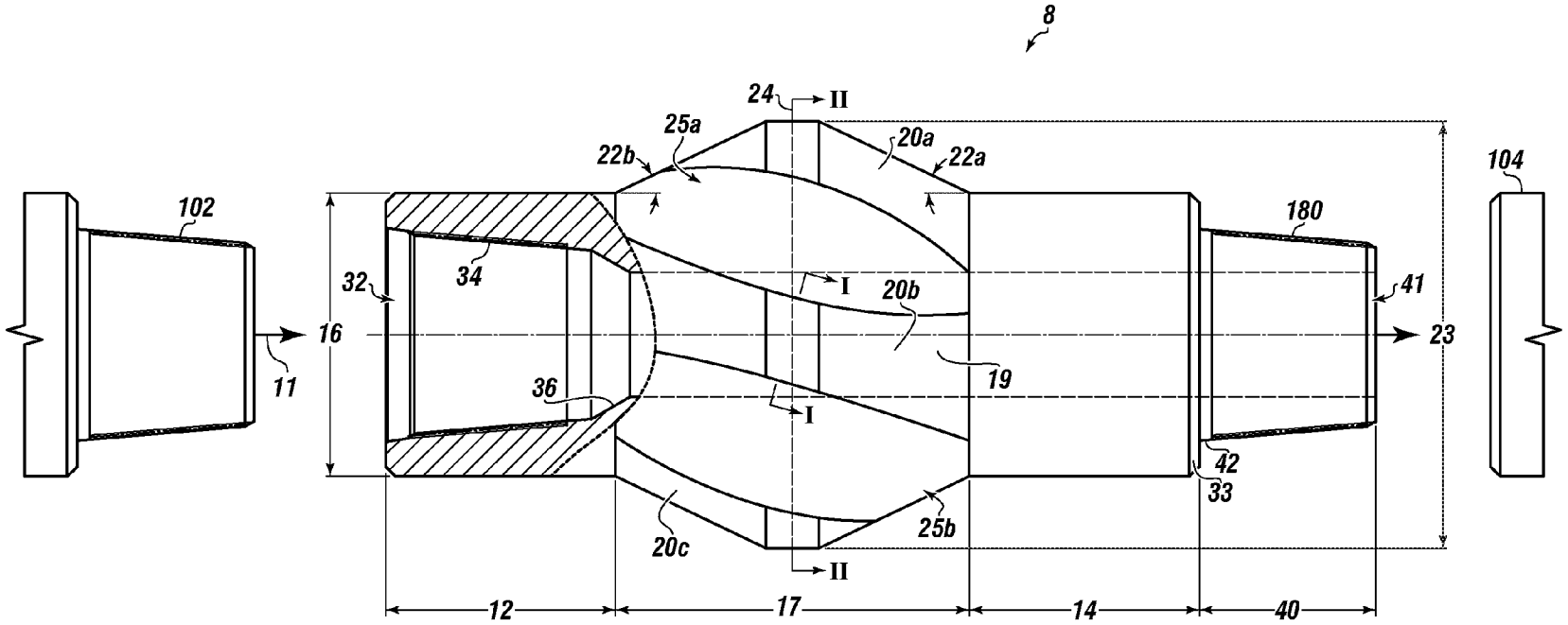
FIG. 1 depicts a side view of a mini-stabilizer tool of the drilling rig according to one or more embodiments.

The present embodiments are detailed below with reference to the listed Figures.

DETAILED DESCRIPTION OF THE EMBODIMENTS

Before explaining the present device in detail, it is to be understood that the of the device is not limited to the particular embodiments and that it can be practiced or carried out in various ways.

The present embodiments relate to a drilling rig with mini-stabilizer tool. The present embodiments further relate to a drilling rig incorporating a small downhole tool that protects, centralizes, and stabilizes drilling and measurement while drilling equipment when attached to a drill string in a wellbore.

In embodiments, the drilling rig with mini-stabilizer tool can be just 26 inches in length and can protect expensive measurement while drilling components on a drill string.

The drilling rig with mini-stabilizer tool can centralize measurement while drilling components, reduce vibration, prevent measurement while drilling components from flopping around in the wellbore, reduce trip time and provide more control to components entering and exiting the well saving lives of operators and hands around the wellbore.

The embodiments further relate to a drilling rig with a mini-stabilizer tool for connecting to a measurement while drilling system, that can simultaneously perform two tasks (a) centralize measurement while drilling components in the wellbore for more accurate measurement to protect measurement while drilling components from wear on shoulders of the measurement while drilling components by positioning the measurement while drilling components away from edges of the wellbore, and (b) smooth the wellbore.

The drilling rig with mini-stabilizer tool can protect measurement while drilling tools as the measurement while drilling tools are run downhole.

The term "centralizing" as used herein can refer to keeping the downhole components, such as the drilling components or the measurement while drilling components from contacting sides of a wellbore. For example, for a 6 inch hole, a midpoint can be at 3 inches. "Centralizing" as used herein can refer to keeping the downhole components off the sides of the wellbore and somewhat centered in the wellbore, but not necessarily at a midpoint in the wellbore. In embodiments, the downhole component can be "centralized" at a slightly off center location in the wellbore.

The term "bore" as used herein can refer to the central conduit formed longitudinally in the mini-stabilizer tool, which can carry drilling fluid, air, or foam downhole to a drill bit or other operating apparatus. The bore can refer to a section of the annulus of the formed mini-stabilizer tool. The "annulus" of the mini-stabilizer tool can be formed from a pin end bore, a cutting section bore, a separator bore, and a box end chamber.

The term "box end" as used herein can refer to the end of the mini-stabilizer tool which can engage a first downhole component, which can be a tubular. In embodiments, the box end can contain threads for threading onto the downhole component. In embodiments, the box end can generally "look up" the wellbore.

The term "downhole component" as used herein can refer to downhole components which can be measurement while drilling equipment, drilling assemblies, operating equipment, a drill string, and a casing string. An example of a drilling assembly can be a bottom hole assembly. An example of operating equipment can be a drill bit.

The term "drilling fluid" as used herein can refer to fluid that flows from a surface tank into a drill string and then through the mini-stabilizer tool and through the downhole component to an operating component, such as a drill bit, for use in the wellbore. Generally drilling fluid does not contain particles from a wellbore.

The term "drilling/measurement while drilling components" as used herein can refer to a reamer, a bottom hole assembly, or instruments that are measuring characteristics of the wellbore. A measurement while drilling component can have a 2 inch range for investigation. When measurement while drilling components are centered a better reading can occur for porosity or rock strength. In embodiments, measurement while drilling components can be often inside a steel tube.

The term "flute" as used herein can refer to a space between blades for flowing cuttings and debris to pass through on an outer surface of the cutting section. A flute can be tapered on one end or tapered on two ends.

The term "hardfacing" as used herein can refer to a plurality of inserts usable for cutting. In embodiment, the hardfacing can be rectangular tungsten carbide inserts. "Hardfacing" can be placed on each helical blade. In embodiments, hardfacing can have a thickness of 0.1 of a millimeter to 3 millimeters.

The term "pin end" as used herein can refer to the end of the mini-stabilizer which engages a second downhole component. In embodiments, the pin end can generally "look down" the wellbore.

The term "separator" as used herein can refer to a portion of the mini-stabilizer tool which can provide a ledge to stop the connection with the drill string or with the second downhole component from touching the helical blades. The separator can be between the tapered pin end and the cutting section. The separator can have a face which can provide a safety stop so that when the pin end engages the second downhole component, the second downhole component does not attach over the helical blades of the mini-stabilizer tool.

The term "smoothing" as used herein can refer to cutting using diamond cutting nodes or carbide inserts and helical blades by removing ledges, particles, debris, or similar material from the sides of the wellbore which make the wellbore sides rough, and thereby once removed, creates a surface which is more uniform, such as planar, with fewer obstructions sticking out of the sides of the wellbore.

The term "tapered neck" as used herein can refer to a portion of the mini-stabilizer tool between the tapered pin end and the separator.

The term "wellbore" as used herein can refer to a bore for an oil well, water well or well to retrieve other hydrocarbons from the earth. In embodiments, the wellbore can be a horizontal hole in the earth, such as a hole for crossing riverbeds.

The term "wellbore fluid" as used herein can be drilling fluid that has flowed from the drill string and mini-stabilizer into the wellbore. Generally wellbore fluid contains particles.

In embodiments the drilling rig can use a mini-stabilizer tool that can have two box ends or two pin ends.

In embodiments, the drilling rig can use a mini-stabilizer tool that can transition from a measurement while drilling tool to a drill string or made up into the measurement while drilling string directly. The measurement while drilling string can be anywhere from 20 feet to 50 feet long.

Turning now to the Figures, FIG. 1 depicts a side view of the mini-stabilizer tool of the drilling rig.

The mini-stabilizer tool 8 can be used for protecting downhole components and measurement while drilling (MWD) components by preventing contact with a wellbore and centering the tools in the wellbore. The mini-stabilizer tool 8 can keep the downhole components and the measurement while drilling components off the wellbore.

In embodiments, the mini-stabilizer tool 8 can connect to a measurement while drilling system. In embodiments, the mini-stabilizer tool can be configured to simultaneously (a) centralize downhole components in a wellbore to protect downhole components from undue wear, and (b) smooth the wellbore while delivering drilling fluid to a downhole component or an operating component and allowing wellbore fluid to flow back upwell unimpeded.

The mini-stabilizer tool can have a box end 12 with a constant outer diameter 16 and a box end chamber 32 for flowing drilling fluid into the box end 12 from a first downhole component 102. The first downhole component 102 is shown not yet attached to the box end 12.

The box end chamber 32 can have a tapered inner wall 34 for removable engagement with the first downhole component 102.

The first downhole component 102 can be measurement while drilling equipment, drilling assemblies, operating equipment, a drill string, or a casing string.

On an end opposite the box end, the mini-stabilizer tool can have a tapered pin end 40 with a pin end bore 41 for flowing drilling fluid 11 through the tapered pin end from the box end.

The tapered pin end 40 can removably engage a second downhole component 104.

The second downhole component 104 can be measurement while drilling equipment, drilling assemblies, operating equipment, a drill string, or a casing string.

The shaft can have a cutting section 17 fluidly connected between the box end 12 and the tapered pin end 40.

The cutting section 17 can have a plurality of helical blades 20*a*, 20*b*, and 20*c* formed longitudinally between the box end 12 and the tapered pin end 40.

The plurality of helical blades 20*a*, 20*b*, and 20*c* can create a cutting section outer diameter 23, which can be larger than the constant outer diameter 16 of the box end 12.

The cutting section 17 is depicted with a plurality of flutes 25*a* and 25*b*.

In embodiments, the plurality of flutes can be formed between a pair of helical blades of the plurality of helical blades.

The cutting section can have a cutting section bore 19 for flowing drilling fluid 11 from the box end 12 toward the tapered pin end 40.

The plurality of flutes can allow wellbore fluid to flow across an outer surface of the mini-stabilizer tool in a direction opposite the drilling fluid.

The mini-stabilizer tool can have a separator 14 fluidly connected between the tapered pin end 40 and the cutting section 17.

The separator 14 can be configured with a face 33 on an end opposite the cutting section 17 proximate the tapered pin end 40.

The face 33 can be adapted to prevent the second downhole component 104 from connecting with the plurality of helical blades 20*a*, 20*b*, and 20*c*.

The separator can have a diameter slightly larger than the tapered pin end at its largest diameter but smaller than the cutting section outer diameter 23.

In embodiments, the drilling rig with mini-stabilizer tool can simultaneously smooth a wellbore; center the two downhole components in a wellbore to protect the downhole components from damage as a drill string to which the downhole components can be attached can be rotated in a wellbore; and flow drilling fluid from a surface location to the second downhole component all while drilling a well.

In embodiments, the box end chamber 32 can form a locking connection with the first downhole component 102 while simultaneously forming a fluid connection with the first downhole component.

In embodiments, the mini-stabilizer tool can have one helical blade of the plurality of helical blades extend from the tapered pin end at a first angle 22*a* and an additional helical blade of the plurality of helical blades can extend from the box end at second angle 22*b*.

In embodiments, the first angle 22*a* and the second angle 22*b* can range from 1 degree to 50 degrees.

In embodiments, the first angle and second angle can be identical angles. In other embodiments, the first angle and the second angle can be different angles.

An example of a first downhole component can be a measurement while drilling component such as a density measurement tool for measuring density of a formation.

An example of a second downhole component can be a bottom hole assembly.

In embodiments, the constant outer diameter 16 can range from 4 inches to 18 inches.

In embodiments, the plurality of helical blades 20*a*, 20*b*, and 20*c* can extend from the box end 12 and increase in diameter from the constant outer diameter 16 towards a blade center point 24 then decrease in overall diameter towards the separator 14 to match a smaller outer diameter of the separator 14, which can be from 2 percent to 25 percent less in diameter than the blade center point 24.

In embodiments, the plurality of helical blades can increase the overall diameter of the mini-stabilizer tool 8 and form the cutting section outer diameter 23 which can be up to 20 percent larger than the constant outer diameter 16. In other embodiments, the cutting section outer diameter 23 can be 10 percent larger than the constant outer diameter 16.

In embodiments, the plurality of flutes 25*a* and 25*b* can be formed to allow wellbore fluid to flow from downhole around the mini-stabilizer tool and up to the surface.

An example of the measurement while drilling component can be an acoustic measurement tool for sending sound waves through the rock to determine the porosity. Acoustic measurement tools are also known as porosity measurement tools.

Tapered nose threads 180 can be disposed on an outer surface of the tapered pin end 40. The tapered nose threads can enable a secure make up to the second downhole component 104. The tapered nose threads 180 can be used to threadably engage the second downhole component in a leak tight engagement.

In embodiments, the tapered pin end 40 can have a tapered neck 42 connected to the separator 14 opposite the plurality of helical blades.

In embodiments, the box end chamber 32 with the tapered inner wall 34 can lead to a narrowing inner surface 36 for fluidly connecting the box end chamber 32 with the cutting section bore 19 while simultaneously forming a locking connection with the first downhole component, which can also be a fluid connection.

Figure 2:
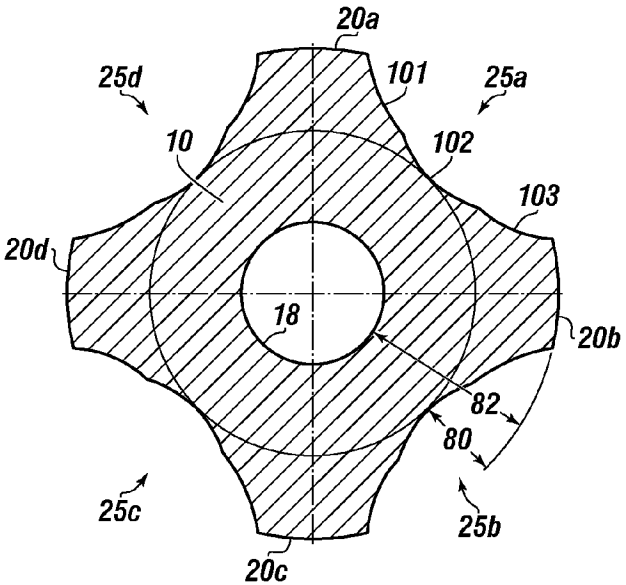
FIG. 2 depicts a cut view of a blade portion of the mini-stabilizer tool of the drilling rig from along cut lines B-B of FIG. 1.

FIG. 2 depicts a cross section of the blade portion of the mini-stabilizer tool from along cut lines B-B of FIG. 1 of the drilling rig.

In this embodiment, a plurality of helical blades 20*a*, 20*b*, 20*c*, and 20*d* are shown in cross section around an annulus 18 of the shaft 10. A plurality of flutes 25*a*, 25*b*, 25*c* and 25*d* are shown with one flute of the plurality of flutes between at least one pair of helical blades of the plurality of helical blades.

The plurality of flutes 25*a*, 25*b*, 25*c*, and 25*d* can have a flute depth 80. The flute depth 80 can extend into the shaft 10 from 10 percent to 50 percent of a shaft depth 82. Each flute can have a plurality of concave sections 101, 102, and 103.

In other embodiments, the separator, the constant outer diameter, and the shaft can be identical in size.

In embodiments, the shaft can have an overall length from 4 inches to 45 inches.

The annulus 18 of the shaft 10 can flow drilling fluid downhole.

The bore formed from the components of the shaft as described can range in diameter from 0.5 of an inch to 12 inches.

Figure 3:
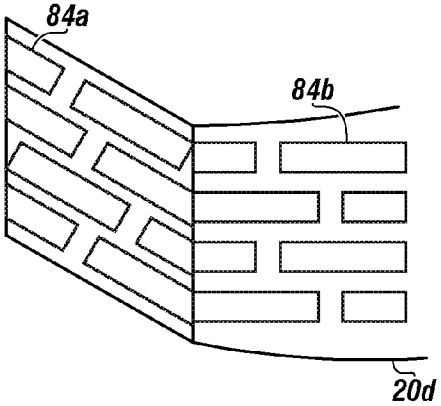
FIG. 3 depicts of one of the helical blades of the mini-stabilizer tool of the drilling rig with a plurality of flat carbide inserts.

FIG. 3 depicts one helical blade of the plurality of helical blades wherein the mini-stabilizer tool has a plurality of flat carbide inserts.

One helical blade of the plurality of helical blades 20*d* of the mini-stabilizer tool is shown with the plurality of flat carbide inserts 84*a* and 84*b*.

In this embodiment, the mini-stabilizer tool is shown with the plurality of flat carbide inserts 84*a* and 84*b* mounted over at least 50 percent of an outer surface of one helical blade of the plurality of helical blades 20*d*, wherein the plurality of flat carbide inserts can be flush with the outer surface.

In embodiments, each helical blade of the plurality of helical blades can be covered with identical patterns of the plurality of flat carbide inserts, each helical blade of the plurality of helical blades can have a different pattern, or a pair of helical blades of the plurality of helical blades can have similar patterns.

In embodiments, the plurality of flat carbide inserts can have a length from ¼ of an inch to ⅝ of an inch. The plurality of flat carbide inserts can have a width from ¼ of an inch to ⅛ of an inch and a thickness from ⅛ of an inch to ⅜ of an inch.

In embodiments, an example of the at least one flat carbide insert can be ones available from Dynalloy Industries, Inc. from College Station, Tex.

In embodiments, the at least one flat carbide insert can be rectangular in shape, square in shape, or another angular shape.

Figure 4:
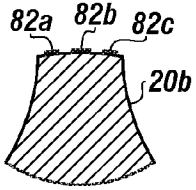
FIG. 4 depicts a detailed view of one of the helical blades of the mini-stabilizer tool of the drilling rig with a plurality of cutting nodes taken from along cut lines A-A of FIG. 1.

FIG. 4 depicts a detailed view of one helical blade of the plurality of helical blades of the mini-stabilizer tool of the drilling rig, wherein the mini-stabilizer tool has a plurality of cutting nodes taken from along cut lines A-A of FIG. 1.

The mini-stabilizer tool is shown having a plurality of raised tungsten carbide inserts 82*a*, 82*b*, and 82*c*.

In this embodiment, the mini-stabilizer tool is shown with a plurality of raised tungsten carbide inserts 82*a*, 82*b*, and 82*c*, which can be mounted over at least 50 percent of the outer surface of one helical blade of the plurality of helical blades 20*d*. The plurality of raised tungsten carbide inserts can extend from 0.1 of a millimeter to 3 millimeters from the outer surface of one helical blade of the plurality of helical blades.

In embodiments, the plurality of raised tungsten carbide inserts can be circular and can be raised from 0.1 of an inch to 0.3 of an inch from the surface of one helical blade of the plurality of helical blades.

Figure 5:
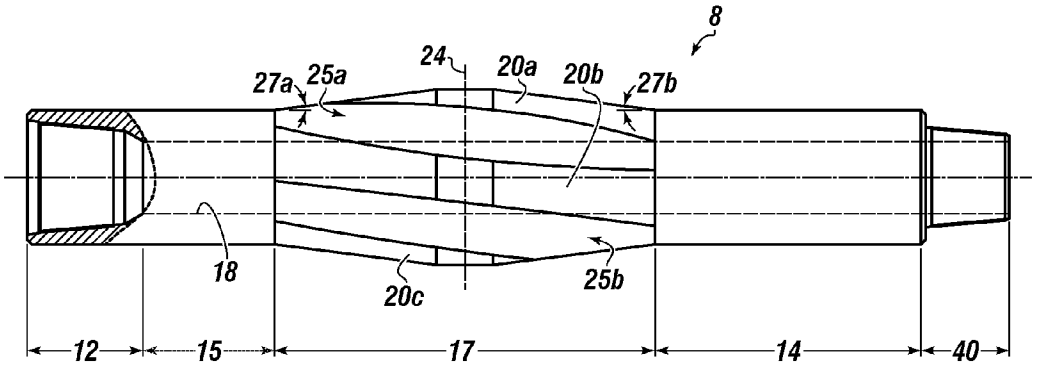
FIG. 5 depicts the mini-stabilizer tool of the drilling rig according to one or more embodiments.

FIG. 5 depicts the mini-stabilizer tool of the drilling rig according to one or more embodiments.

In embodiments, the mini-stabilizer tool 8 can have a box end extension 15 formed between the cutting section 17 and the box end 12.

The box end extension 15 can have an extension fluid bore 29 for flowing drilling fluid from the box end to the cutting section. In embodiments, the outer diameter of the box end extension 15 can be identical to the constant outer diameter. In embodiments, the outer diameter of the box end extension can be different from the constant outer diameter.

The plurality of helical blades 20*a*, 20*b*, and 20*c* can be depicted as raising away from the box end extension 15 at a first smaller angle 27*a* to the blade centerpoint 24.

The plurality of helical blades 20*a*, 20*b*, and 20*c* can be depicted rising to the center point 24, and then decreasing at a second smaller angle 27*b* towards the separator 14.

The separator 14 can be shown connected to a tapered pin end 40.

One flute of the plurality of flutes 25*a* is shown between a pair of helical blades of the plurality of helical blades 20*a* and 20*b* and one additional flute of the plurality of flutes 25*b* is shown between the pair helical blades of the plurality of helical blades 20*b* and 20*c*.

Figure 6:
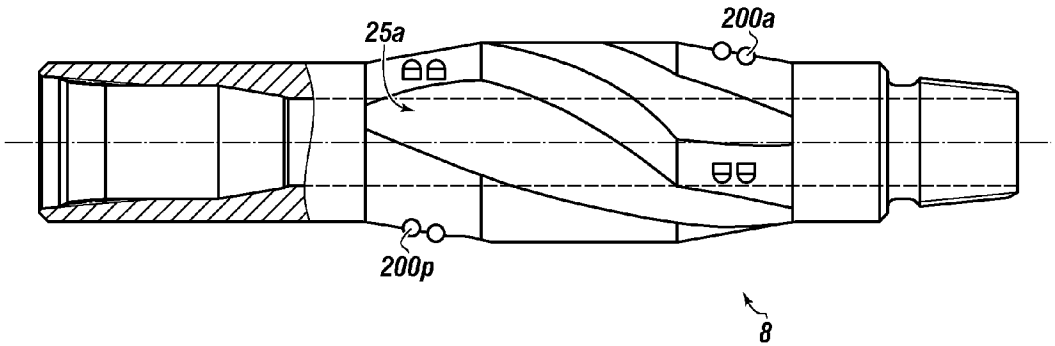
FIG. 6 depicts the mini-stabilizer tool of the drilling rig with cutting nodes disposed on the helical blades.

FIG. 6 depicts the mini-stabilizer tool of the drilling rig with the plurality of cutting nodes disposed on the pair of helical blades of the plurality of helical blades.

The mini-stabilizer tool 8 is shown having a plurality of cutting nodes 200*a*-200*p* disposed on the edges of the plurality of helical blades. In embodiments, each cutting node of the plurality of cutting nodes can be formed from polycrystalline diamond compact (PDC).

In embodiments, at least one polycrystalline diamond compact (PDC) cutting node can be disposed on an edge of the at least one helical blade of the plurality of helical blades. One flute of the plurality of flutes 25*a* is shown between the pair of helical blades of the plurality of helical blades having the plurality of cutting nodes, which can be depicted as circular in this embodiment and raised from the surface of one helical blade of the plurality of helical blades.

In embodiments, each flute of the plurality of flutes can have a tapered end.

In embodiments, the mini-stabilizer tool 8 can have from 2 helical blades to 6 helical blades.

The plurality of helical blades do not have to be symmetrically oriented on the cutting section.

In embodiments, the helical blade section can be off center in the mini-stabilizer tool.

In embodiments, the box end can have a longitudinal length that can be 10 percent to 45 percent of the total length of the mini-stabilizer tool, the tapered pin end can have a longitudinal length that can be 10 percent to 45 percent of the total length of the mini-stabilizer tool, the cutting section can have a longitudinal length that can be 15 percent to 70 percent of the total length of the mini-stabilizer tool and the separator can have a longitudinal length that can be 10 percent to 45 percent of the total length of the mini-stabilizer tool.

The min-stabilizer tool can be designed to rotate as the drill string to which it can be attached rotates.

In embodiments, each flute of the plurality of flutes can extend the entire length of the helical blade section. Each flute of the plurality of flutes can taper 10 percent at each end, rising from the deepest part of each flute of the plurality of flutes to a flush surface with the helical blade section.

In embodiments, the plurality of flutes can be elliptical.

In embodiments, each helical blade of the plurality of helical blades can have a spiral angle of 11 degrees plus or minus 0.5 of a degree. In a 4.6 inch long embodiment of the mini-stabilizer tool, each outside diameter and each inside diameter of the mini-stabilizer tool can have a diameter bevel of 45 degrees.

In embodiments, the mini-stabilizer tool can include hardfacing on the plurality of helical blades. In embodiments, the hardfacing can be placed on each helical blade of the plurality of helical blades, having a thickness of 3 millimeters.

In an embodiment for a 5.7 inch long mini-stabilizer tool, each helical blade of the plurality of helical blades can have a spiral angle of 13.5 degrees, plus or minus 0.5 of a degree. In the 5.7 inch long embodiment, each outside diameter and each inside diameter of the mini-stabilizer tool can have a diameter bevel of 45 degrees.

The mini-stabilizer tool is anticipated to conform to American Petroleum Institute (API) standard 7-1 as it was in force in May 2014.

In an embodiment for a 6 and ⅛ inch long mini-stabilizer tool, each helical blade of the plurality of helical blades can have a spiral angle of 20 degrees, plus or minus 0.5 of a degree. In the 12 inch long embodiment, each outside diameter and each inside diameter of the mini-stabilizer tool can have a diameter bevel of 45 degrees.

In this embodiment, the mini-stabilizer tool can have four helical blades, which can be uniformly distributed on the shaft.

In an embodiment for an 8.25 inch long mini-stabilizer tool, each helical blade of the plurality of helical blades can have a spiral angle of 20 degrees, plus or minus 0.5 of a degree. In the 8.25 inch long embodiment, each outside diameter and each inside diameter of the mini-stabilizer tool can have a diameter bevel of 45 degrees.

In an embodiment for a 12 inch long mini-stabilizer tool, each helical blade of the plurality of helical blades can have a spiral angle of 30 degrees, plus or minus 0.5 of a degree. In the 12 inch long embodiment, each outside diameter and each inside diameter of the mini-stabilizer tool can have a diameter bevel of 45 degrees.

Rectangular tungsten carbide inserts, also known as hardfacing can be placed on each helical blade of the plurality of helical blades. Each hardfacing can have a thickness of 3 millimeters.

In an embodiment for a 12.1 inch long mini-stabilizer tool, each helical blade of the plurality of helical blades can have a spiral angle of 30 degrees, plus or minus 0.5 of a degree. In the 12 inch long embodiment, each outside diameter and each inside diameter of the mini-stabilizer tool can have a diameter bevel of 45 degrees.

Figure 7:
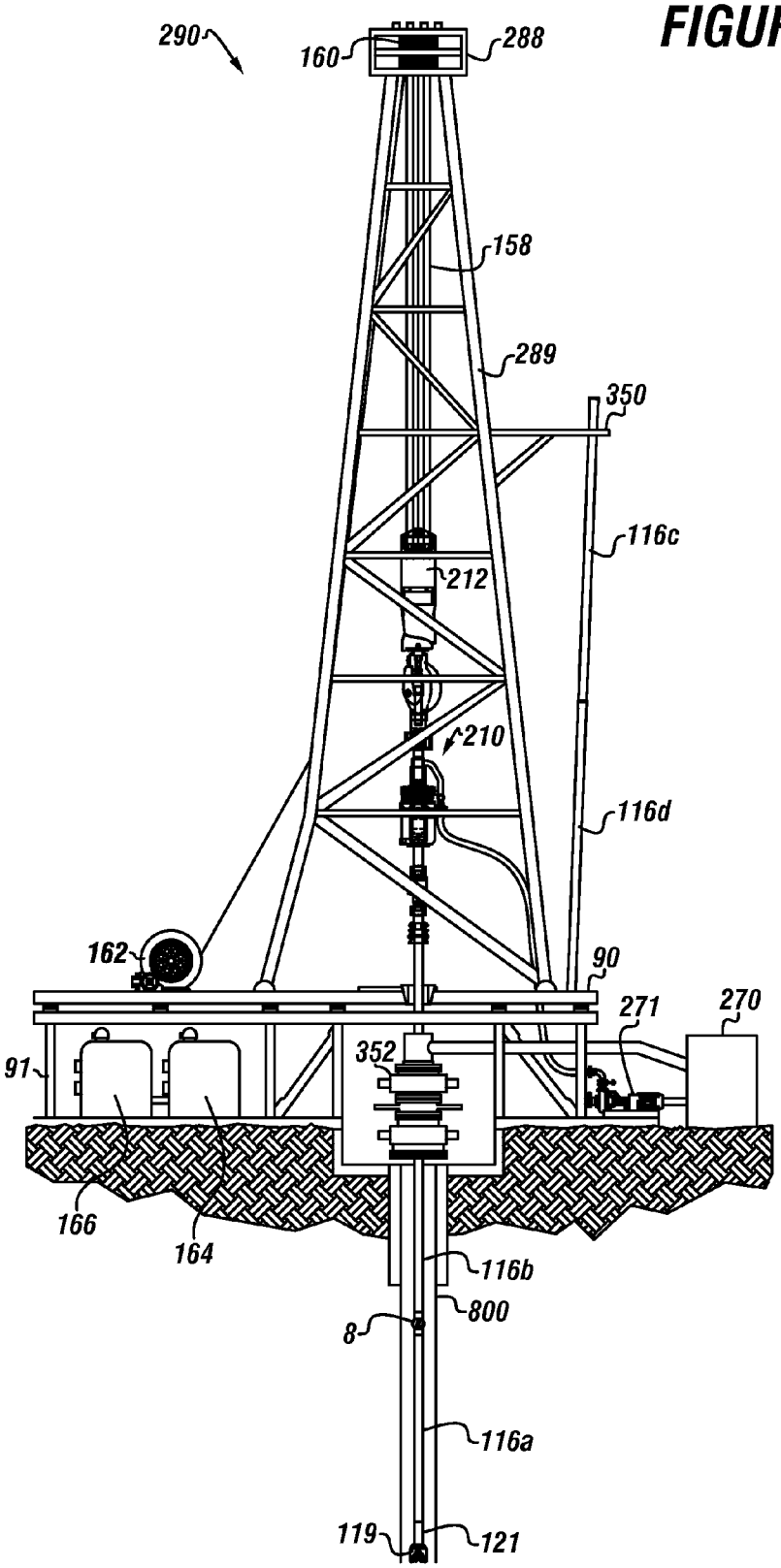
FIG. 7 depicts a drilling rig with the mini-stabilizer tool according to one or more embodiments.

FIG. 7 depicts a drilling rig with improved safety having a mini-stabilizer tool for connecting to downhole components according to one or more embodiments.

The mini-stabilizer tool can be configured to simultaneously smooth a wellbore, centralize the downhole components from wear and damage and flow drilling fluid to at least one downhole component or at least one operating component while allowing wellbore fluid to flow to a surface unimpeded, The drilling rig 290 can have a tower 289 having a crown 288 with a plurality of sheaves 160.

In embodiments, the tower can be a derrick. The derrick can have a rig floor 90 and a rig floor substructure 91.

The drilling rig 290 can have a drawworks 16 connected with a drawworks motor 164 connected to a power supply 166.

A cable 158 can extend from the drawworks 162 through the plurality of sheaves 160 over the crown 288. A lifting block 212 can be connected to the cable 158.

A hydraulic pump 271 can be fluidly connected to a tank 270 for flowing fluid into the wellbore as drill pipe is turned into the wellbore.

A rotating means 210 can be used for turning drill pipe into the wellbore. The rotating means 210 is depicted as either a top drive or a power swivel mounted to the lifting block.

In other embodiments, the rotating means can be a rotary table mounted to a rig floor for rotating drill pipe into a wellbore.

A blowout preventer 352 can be connected between the rotating means and the wellbore for receiving drill pipe.

The mini-stabilizer tool 8 is depicted mounted between a first drill pipe section 116*a* and a second drill pipe section 116*b*. The mini-stabilizer tool can save the measurement while drilling components 121 and the bottom hole assembly 119 down hole in the wellbore 800.

A third tubular 116*c* and fourth tubular 116*d* are also shown, which can be mounted on the rig floor 90 in the racking position 350 prior to rotating into the well with the drilling rig with mini-stabilizer tool.

While these embodiments have been described with emphasis on the embodiments, it should be understood that within the scope of the appended claims, the embodiments might be practiced other than as specifically described herein.

What is claimed is:

1. A drilling rig having a mini-stabilizer tool for connecting to downhole components, the mini-stabilizer tool configured to simultaneously smooth a wellbore, centralize the downhole components from wear and damage and flow drilling fluid to at least one downhole component or at least one operating component while allowing wellbore fluid to flow to a surface unimpeded, the drilling rig comprising:

a) a tower having a crown with a plurality of sheaves;

b) a drawworks connected to a drawworks motor, the drawworks motor connected to a power supply;

c) a cable extending from the drawworks through the plurality of sheaves over the crown;

d) a lifting block connected to the cable;

e) a hydraulic pump connected to a tank for flowing fluid into the wellbore as a drill pipe is turned into the wellbore;

f) a rotating means for turning the drill pipe into the wellbore;

g) a blowout preventer connected between the rotating means and the wellbore for receiving the drill pipe; and h) the mini-stabilizer tool mounted in a first drill pipe section and a second drill pipe section as the drill pipe is run into the wellbore to prevent wear and damage to the at least one downhole component or the at least one operating component; wherein the mini-stabilizer tool comprises:

i) a shaft configured to flow the drilling fluid downhole;

ii) a box end with a constant outer diameter and a box end chamber for flowing the drilling fluid through the box end, the box end chamber having a tapered inner wall for removable engagement with a first downhole component;

iii) a tapered pin end with a pin end bore for flowing the drilling fluid through the tapered pin end, wherein the tapered pin end removably engages a second downhole component; and iv) a cutting section fluidly connected between the box end and the tapered pin end, wherein the cutting section comprises:

1) a plurality of helical blades formed longitudinally between the box end and the tapered pin end, the plurality of helical blades of the cutting section creates a cutting section outer diameter that is larger than the constant outer diameter of the box end;

2) a plurality of flutes, each flute of the plurality of flutes consisting of a plurality of concave sections, each flute formed between a pair of helical blades of the plurality of helical blades, each flute for flowing the wellbore fluid across an outer surface of the mini-stabilizer tool; and 3) a cutting section bore for flowing the drilling fluid from the box end toward the tapered pin end; and v) a separator fluidly connected between the tapered pin end and the cutting section, the separator configured with a face on an end opposite the cutting section, the separator adapted to prevent the second downhole component from connecting with the plurality of helical blades, the separator having a diameter slightly larger than the tapered pin end at its largest diameter but smaller than a cutting section outer diameter.

2. The drilling rig of claim 1, wherein the second downhole component is at least one of: a bottom hole assembly or a measurement while drilling component.

3. The drilling rig of claim 1, wherein the box end chamber forms a locking connection with the first downhole component while simultaneously forming a fluid connection with the first downhole component.

4. The drilling rig of claim 1, wherein each helical blade of the plurality of helical blades extends from the tapered pin end at a first angle and each helical blade of the plurality of helical blades extends from the box end at a second angle, wherein the first angle and the second angle range from 1 degree to 50 degrees.

5. The drilling rig of claim 1, comprising a plurality of flat carbide inserts mounted over at least 50 percent of an outer surface of the plurality of helical blades, wherein the plurality of flat carbide inserts are flush with the outer surface of the plurality of helical blades.

6. The drilling rig of claim 1, comprising a plurality of raised tungsten carbide inserts mounted over at least 50 percent an outer surface of the plurality of helical blades, wherein the plurality of raised tungsten carbide inserts extend from 0.1 of a millimeter to 3 millimeters from the outer surface of the plurality of helical blades.

7. The drilling rig of claim 1, comprising at least one polycrystalline diamond compact cutting node disposed on an edge of one helical blade of the plurality of helical blades.

8. The drilling rig of claim 1, comprising a box end extension formed between the cutting section and the box end, wherein the box end extension has an extension fluid bore for flowing the drilling fluid from the box end to the cutting section.

9. The drilling rig of claim 1, wherein the cutting section comprises from 2 helical blades to 6 helical blades of the plurality of helical blades.

10. The drilling rig of claim 1, wherein the tapered pin end comprises tapered nose threads disposed on an outer surface of the tapered pin end for threadably engaging the second downhole component in a leak tight engagement.

11. The drilling rig of claim 1, wherein the first downhole component and the second downhole component is at least one of: measurement while drilling equipment, a drilling assembly, operating equipment, a drill string, and a casing string.

12. The drilling rig of claim 11, wherein the drilling assembly is a bottom hole assembly and the operating equipment is a drill bit.

13. The drilling rig of claim 1, wherein the separator has an outer diameter larger than a tapered pin end outer diameter but smaller than the cutting section outer diameter.

14. The drilling rig of claim 1, comprising a blade centerpoint, wherein the plurality of helical blades extends from the box end and increases in diameter from the constant outer diameter towards the blade centerpoint then decreases in overall diameter towards the separator to match an outer diameter of the separator.

15. The drilling rig of claim 1, comprising a tapered neck connected between the separator and the tapered pin end.

16. The drilling rig of claim 1, wherein the rotating means comprises at least one of: a top drive or a power swivel mounted to the lifting block or a rotary table mounted to a rig floor for rotating the drill pipe into the wellbore.

* * * * *